US007574269B2

(12) United States Patent
Cenedese et al.

(10) Patent No.: US 7,574,269 B2
(45) Date of Patent: Aug. 11, 2009

(54) DOMESTIC APPLIANCE ASSEMBLY WITH INTEGRATED FUNCTIONING

(75) Inventors: Claudio Cenedese, Udine (IT); Roberto Bottos, Pordenone (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 158 days.

(21) Appl. No.: 11/344,869

(22) Filed: Feb. 1, 2006

(65) Prior Publication Data

US 2006/0200255 A1 Sep. 7, 2006

(30) Foreign Application Priority Data

Mar. 4, 2005 (EP) ..... 05101676

(51) Int. Cl.
*G05B 11/01* (2006.01)
*G05B 15/00* (2006.01)

(52) U.S. Cl. ..... 700/17; 700/83

(58) Field of Classification Search ..... 700/17, 700/83

See application file for complete search history.

(56) References Cited

U.S. PATENT DOCUMENTS 5,436,510 A 7/1995 Gilbert
5,444,996 A * 8/1995 Joslin et al. ..... 68/12.04
5,570,085 A 10/1996 Bertsch
5,815,086 A 9/1998 Ivie et al.
5,978,371 A * 11/1999 Mason et al. ..... 370/389
6,862,496 B2 * 3/2005 Fukuoka et al. ..... 700/237
7,096,601 B2 * 8/2006 Lyu et al. ..... 34/595
7,216,514 B2 * 5/2007 Sakita et al. ..... 68/12.12
2003/0234737 A1 * 12/2003 Nelson et al. ..... 341/176
2004/0118008 A1 * 6/2004 Jeong et al. ..... 34/425
2006/0021153 A1 * 2/2006 Lee ..... 8/158
2006/0117491 A1 * 6/2006 Kim ..... 8/158

FOREIGN PATENT DOCUMENTS

EP 1548174 * 6/2005

OTHER PUBLICATIONS

Wikipedia definition for "serial port"; 6 pages.*
Wikipedia definition for "printed circuit board"; 9 pages.*

* cited by examiner

*Primary Examiner*—Ronald D Hartman, Jr.
(74) *Attorney, Agent, or Firm*—Pearne & Gordon LLP

(57) ABSTRACT

A domestic appliance assembly comprising at least two machines, each of which being provided with control means able to receive program inputs set by a user and operative information transmitted by the other machine so as said machines can perform their functions in an integrate and synchronised way.

Each machine (10,12) comprise a wireless communication module (14) adapted to exchange information directly between the machines and means (16) to process said information and to synchronise the machine functioning.

The domestic appliance assembly according to the invention allows to accomplish a better power management, to avoid electrical overloads, and to synchronise the appliance functioning.

5 Claims, 1 Drawing Sheet

DOMESTIC APPLIANCE ASSEMBLY WITH INTEGRATED FUNCTIONING

The present invention refers to a new and improved assembly of domestic appliances, which is able to operate in such a way to exchange information and synchronise the relevant functioning, in order to manage the electrical power by avoiding any overload.

It is known to associate different appliances and to control them, so as to integrate their functions. This technical solution is performed by using electronic control means which receive program inputs set by the user and operative outputs issued by specific sensors associated to each appliance. The electronic control means process said data and send suitable signals to the connected appliances in order to drive them in an integrate and coordinate mode.

Generally speaking, the technics to carry out said control systems are known as "home automation" and comprise a great variety of hardware and software solutions.

U.S. Pat. Nos. 5,436,510 and 5,570,085, mentioned only for example, disclose appliance control systems for globally managing electric power.

U.S. Pat. No. 5,815,086 discloses an automated appliance control system wherein a universal transmitter can receive instructions from a central audio/visual controller. Control signals, issued by a hand-held infrared transmitter or any appliance automation controller which is connected to the signal-carrying bus, direct the universal transmitter to transmit infrared signals to the appliance to be controlled.

Therefore, all known solutions are characterised by a constructive and functional complexity, due to the need of specific and separate control modules, as well as an electric network or electronic bus to be set in the home environment.

Moreover, in case of two or more appliances normally dealing with the same item it would be suitable and favourable to find a more simple and economic solution to coordinate the relevant functions.

For instance, a washing machine and a dryer are two machines performing different functions on a same item, i.e. a laundry load, in successive times. It is known that the working programs of said machines are based on the characteristics of weight and kind of laundry load, which are set by the user or are directly identified by the machine, by known means.

Normally, the washing machine and the dryer are programmed individually and this procedure may involve various drawbacks, due to the difficulty to evaluate correctly the specific characteristics of the laundry load, e.g. the weight of the dry laundry in the washer and of the corresponding wet laundry in the dryer.

It would be advisable and it is the main scope of the present invention to carry out an assembly of appliances, e.g. a washing machine and a tumble dryer, which can exchange information reciprocally and directly in order to allow each machine selects the appropriate operative program according to the exchanged information.

Another scope of the invention is to carry out such an assembly which does not need special and external control devices or a specific network to transmit signals between two machines.

Yet another scope of the invention is to carry out an appliance assembly which is operated in an integrated and synchronised way without need of physical connections or components outside the appliances.

Yet another scope of the invention is to modify the involved machines in a way that does not prevent their independent functioning too, so as to have a very flexible solution.

According to the present invention, these aims are set forth above are reached in a domestic appliance assembly as recited in the appended claims.

Features and advantages of the present invention will anyway be more readily understood from the description that is given below by way of non limiting example, with reference to the annexed designs in which.

Figure 1:
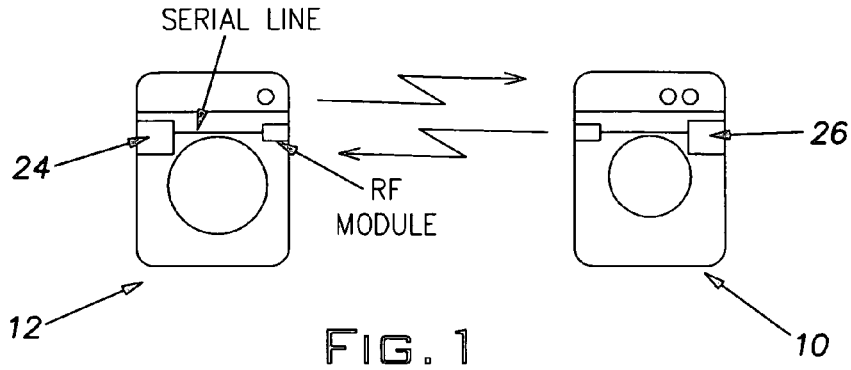
FIG. 1 shows a schematic functional view of two appliances connected with the system following the present invention.

The domestic appliance assembly represented in the drawings comprises (FIG. 1) a washing machine 10 and a tumble dryer 12.

Said machines have normally to be programmed so as a laundry load is firstly washed in the washing machine and then dried in the tumble dryer.

Both the programs of the washing machine and of the tumble dryer are selected by considering some characteristics of the laundry load to be treated, particularly kind and weight of the laundry.

In view of the need to manage the electrical power in the best way by avoiding any overload, the operations of the machines must be synchronised. Therefore, information on the relevant functioning have to be exchanged between the machines.

Figure 2:
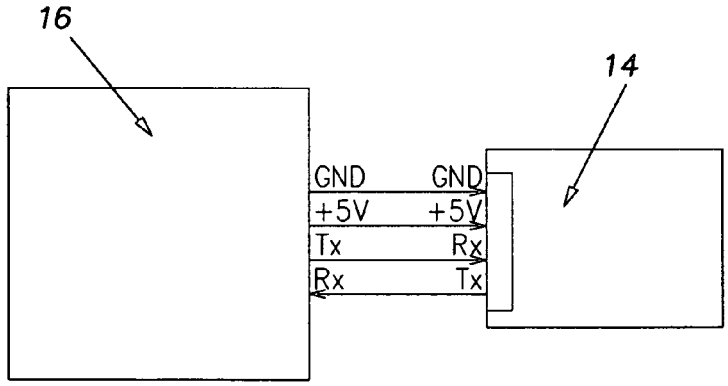
FIG. 2 shows schematically the main feature of the communication system following the present invention.

According with the invention, said exchange of information is performed by means of a wireless communication system through a radio frequency link (RF). For this purpose, each machine is provided with a wireless communication module 14 (FIG. 2) and an electronic controller 16. The RF module 14 and the controller 16 are connected by means of a serial line.

Figure 3:
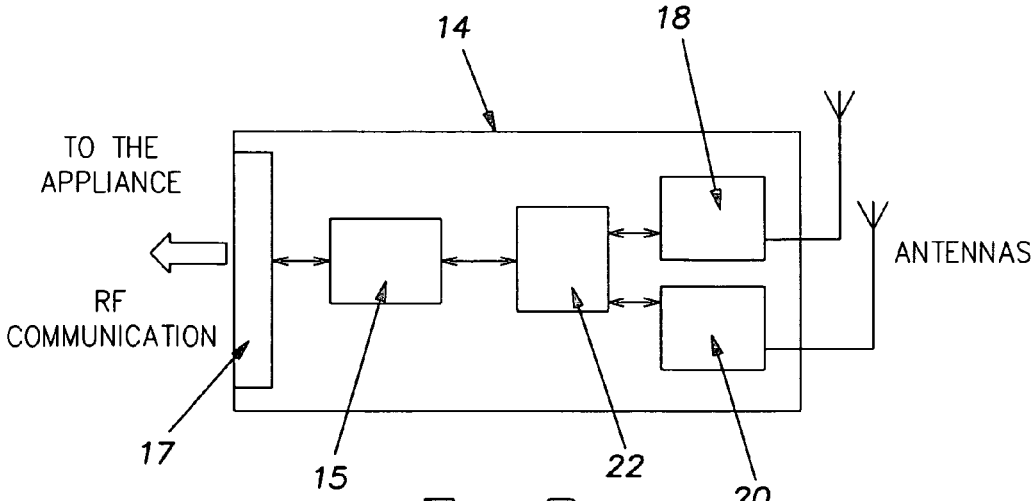
FIG. 3 shows a block diagram of one component of the feature of FIG. 2.

The RF module 14 is identical for the washing machine and the tumble dryer and comprises on board a RF transmitter 18 (FIG. 3) and a RF receiver 20, which are managed by a micro controller 22. Moreover, the RF module 14 embodies a serial line interface 15 and a serial port 17.

The RF module 14 is a communication gateway connected with the appliance. It performs, together with the appliance connected, a start-up procedure. Then, when all the preliminary operations have been completed, the RF module 14 put itself in a "gateway" modality, waiting messages from its motherboard 24 and sending them to the motherboard 26 connected to the RF module of the other appliance and vice versa. The messages are encapsulated in a RF frame, in a known way.

It is important to underline that the RF module 14 is a "pure" gateway, i.e. it takes care only of the communication. Every action taken by the machines are the output of software elaboration of the motherboards 24,26 (FIG. 1) of the machines 10,12 themselves.

The operation of the assembly is as follows.

The tumble dryer 12 is the master of the system. It sends to the washing machine 10 a request message to know the state of the appliance. With the response sent back by the washing machine 10, the master makes the decision about the actions to be performed by both the machines. The actions have to be decided having as goal the limitation of the power consumption. So, the load management is the synchronisation of the appliances.

The major power demands take place during heating (for washing machine and tumble dryer) and spinning phase (only for washing machine). The system avoids the overlapping of these phases, putting one or the other appliance on hold (washing machine and tumble dryer both in heating phase), or reducing the electrical load needed by the dryer. The philosophy is that the appliances start before they can not be stopped (to save heat).

First example: the washing machine 10 starts before the tumble dryer 12.

The tumble dryer 12 waits for the end of the washing phase of the washing machine 10 to start with its standard functionality. Both machines can work together when the washing machine is in rinsing phases and the dryer is turned on and heats a laundry load.

When the washing machine starts with spinning, the tumble dryer must reduce its power request. Normally, the dryer is provided with two heating elements for different powers and the washing machine may perform spinning phases at different speeds. Therefore, the dryer has to be turned off only its smaller heating element in case of intermediate spinning value of the washing machine, whereas the dryer has to be fully turned off in case of highest spinning value.

Second example: the washing machine 10 starts after the tumble dryer 12.

The washing machine has to wait for the end of the drying operation of the dryer to start with its standard functionality. The contemporary functioning of the two machines is allowed only during a possible cooling phase performed by the dryer.

The appliances are normally provided with control means able to receive program inputs set by a user and may also be operated independently as usual.

However, according with the invention, the master appliance (e.g. the dryer 10) is provided with a special position for the knob of its control device. With the knob in said position, the dryer selects the best cycle parameters according to the last cycle done by the washing machine.

It means that via radio frequency the tumble dryer automatically fetches information from the washing machine about the last completed washing program, such as: type of the program (cotton, synthetics, etc.), temperature, spinning speed, current cloths load. The last one is a very important information because it gives the advantage that there is no need of having a weight sensor on the dryer.

Information received by the dryer is used to automatically select the corresponding drying program, to set the correct heating power, and to calculate the correct drying time to be shown on the display.

In conclusion, the domestic appliance assembly according to the invention allows to accomplish a better power management, to avoid electrical overloads, and to synchronise the appliance functioning.

The invention claimed is:

1. A domestic appliance assembly comprising at least two machines (10, 12), each of which comprises:

control means able to receive program inputs set by a user and operative information transmitted by the other machine so as said machines can perform their functions in an integrated and synchronised way;

a wireless communication module comprising a radio frequency module (14) adapted to exchange information directly between the machines (10, 12); and an electronic controller (16) to process said information and to synchronise the machine functioning;

wherein, the control means of each machine comprises an electronic board comprising a serial port (17) which is associated with the radio frequency module (14) in order to connect the radio frequency module (14) to the electronic controller (16), wherein the radio frequency module (14) is adapted to receive information about the functioning state of the respective machine (10 or 12) from the electronic controller (16) via the serial port (17) and to send said information to the controller (16) of the other machine (10 or 12) and vice versa, and wherein one of the controllers (16) is adapted to decide about actions to be performed by both the machines.

2. A domestic appliance assembly according to claim 1, characterised in that the radio frequency module (14) comprises a radio frequency transmitter (18) and a radio frequency receiver (20) managed by a micro controller (22).

3. A domestic appliance assembly according to claim 1, characterised in that the radio frequency module (14) comprise a serial line interface (15).

4. A domestic appliance assembly according to claim 1, characterised in that one of the machine (14) represents the master of the assembly and the control means of this machine are provided with a selector adapted to be positioned according to the different operative cycles, one of the selector positions corresponding to the best cycle depending on the received information from the other machine (12).

5. A domestic appliance assembly according to claim 1, wherein at least one of the controllers (16) is adapted to put one or the other machine (10, 12) on hold, or reduce the electrical load needed by the dryer (12) to avoid the overlapping of highly power-demanding operating phases of the machines (10, 12).

* * * * *